US006189595B1

(12) United States Patent
Lee

(10) Patent No.: US 6,189,595 B1
(45) Date of Patent: Feb. 20, 2001

(54) LOUVERED BLIND LOCK

(76) Inventor: Paul Lee, 12839 Sky Knoll, Houston, TX (US) 77082

( * ) Notice: Under 35 U.S.C. 154(b), the term of this patent shall be extended for 0 days.

(21) Appl. No.: 08/647,754

(22) Filed: May 15, 1996

Related U.S. Application Data

(63) Continuation-in-part of application No. 08/458,398, filed on Jun. 2, 1995, now abandoned.

(51) Int. Cl.[7] ..... E06B 9/30

(52) U.S. Cl. ..... 160/168.1; 160/178.2 R; 160/173 R

(58) Field of Search ..... 160/168.1 V, 168.1 R, 160/173 R, 173 V, 176 R, 176 V, 177 R, 177 V, 178.1 R, 178.1 V, 178.2 R

(56) References Cited

U.S. PATENT DOCUMENTS 2,410,549 * 11/1946 Olson ..... 160/168.1 R
4,813,469 * 3/1989 Scott ..... 160/178.2 R
5,186,229 * 2/1993 Hsu ..... 160/177 R
5,465,775 * 11/1995 Biba et al. ..... 160/178.1 R
5,465,779 * 11/1995 Rozon ..... 160/168.1 V
5,472,035 * 12/1995 Biba et al. ..... 160/168.1 R
5,472,036 * 12/1995 Judkins ..... 160/178.2
5,501,262 * 3/1996 Inaba et al. ..... 160/178.2 R
5,513,687 * 5/1996 Tuzmen et al. ..... 160/168.1 R
5,553,649 * 9/1996 Chisaka et al. ..... 160/168.1 R
5,553,650 * 9/1996 Jelic ..... 160/173 R X
5,553,653 * 9/1996 Rozon ..... 160/173 R
5,850,863 * 12/1998 Huang ..... 160/168.1 R

* cited by examiner

*Primary Examiner*—Bruce A. Lev
(74) *Attorney, Agent, or Firm*—Alan J. Atkinson

(57) ABSTRACT

A cord lock engaged with a vertically moveable handle for selectively engaging and disengaging a cord for transporting vanes in a blind. A rotatable mechanism is proximate with a vertically moveable handle. An extension is attached to the rotatable mechanism, and a cord lock is engaged with the upper end of the extension so that rotation of the rotatable mechanism and extension operates the cord lock to selectively engage the cord. Following such engagement, the handle can be pulled to move the cord and to transport the vanes. The rotatable mechanism can be rotated in the opposite direction to disengage the cord lock from the cord.

9 Claims, 4 Drawing Sheets

Top View

LOUVERED BLIND LOCK

This patent application is a continuation-in-part application based on U.S. Ser. No. 08/458,398 filed Jun. 2, 1995, now abandoned entitled "Louvered Blind Controller", incorportated herein by reference in its entirety.

BACKGROUND OF THE INVENTION

The present invention relates to a controller for operating a louvered blind. More particularly, the present invention relates to an improved cord lock for a louvered blind controller system that encloses an operating cord or chain within a control handle.

Louvered blinds shield window and door openings to block the passage of light and to provide privacy. Louvered blinds are constructed from a plurality of louvers or vanes that can be individually rotated about an axis to open and to close the blind. Typically, the rotation of such vanes is controlled by rotation of a wand attached to a gear mechanism or by pulling on a chain engaged with a gear mechanism.

In a blind where the vanes hang vertically, the blind can be opened and closed by moving the vanes to one side of the opening. This operation is controlled by pulling a cord attached to a mechanism, or by physically pulling the vanes along a track attached to the head rail of the window blind. In a window blind where the vanes are horizontally oriented, the window blind can be raised and lowered by pulling a cord attached to a mechanism that engages the cord to lock the location of the vanes at a desired elevation.

Conventional blinds incorporate a looped cord having two cord lengths. The cord lengths are attached to a mechanism inside the blind that moves the vanes, and either cord length can be pulled to selectively open or close the blind vanes. In other blind designs, either cord length can be pulled to selectively open or close the blind across the opening.

Such looped cords hang free from one side of the blind, and the necessary length of the looped cord depends on the width of the opening. Blinds for large openings require a looped cord extending to the floor, which creates a potential safety hazard for small children. Because of this hazard, efforts have been made to eliminate looped cords from blinds.

In one design of a blind having vertical vanes, a wand controls the rotation of the vanes, and the vanes are manually pulled across the opening to close the blind. Although such blind does not incorporate a looped cord, the blind requires a person to walk along the length of the opening to open or close the blind. This procedure can be difficult when furniture or other obstructions block the window or door opening.

Another concept in window blinds eliminates the looped cord by incorporating an electric powered drive mechanism which selectively operates the blind and the individual vanes. The electric mechanism substantially increases the cost of the window blind and increases the number of mechanical components subject to failure.

One window blind concept is shown in U.S. Pat. No. 5,472,035 to Biba et al. (1995), wherein an elongated wand incorporated a lengthwise passage having an open slot along one side of the wand to permit vertical movement of components relative to the wand. However, the slot substantially weakens the wand and requires additional material for strength. In another design, U.S. Pat. No. 5,465,775 to Biba et al. (1995) disclosed an endless cord operating loop having lift cords connected to the endless loop. Although these concepts position a cord within an elongated wand, such concepts require numerous operating parts and are expensive to manufacture.

Accordingly, a need exists for a improved vertical blind system and cord lock that encloses a cord for operating the blind. The system should be easy to manufacture and to operate.

SUMMARY OF THE INVENTION

The present invention provides an improved cord lock engaged with a moveable handle for selectively engaging and disengaging a cord for transporting vanes in a blind. A rotatable mechanism proximate to the handle is vertically moveable with the handle. An extension is attached to the rotatable mechanism, and a cord lock is engaged with the extension so that rotation of the rotatable mechanism and extension operate the cord lock to selectively engage or disengage the cord. In alternative embodiments of the invention, the handle can include a weight or a pulley and spring attached to the cord for preventing slack for accumulating in the cord.

DESCRIPTION OF THE PREFERRED EMBODIMENTS

Figure 1:
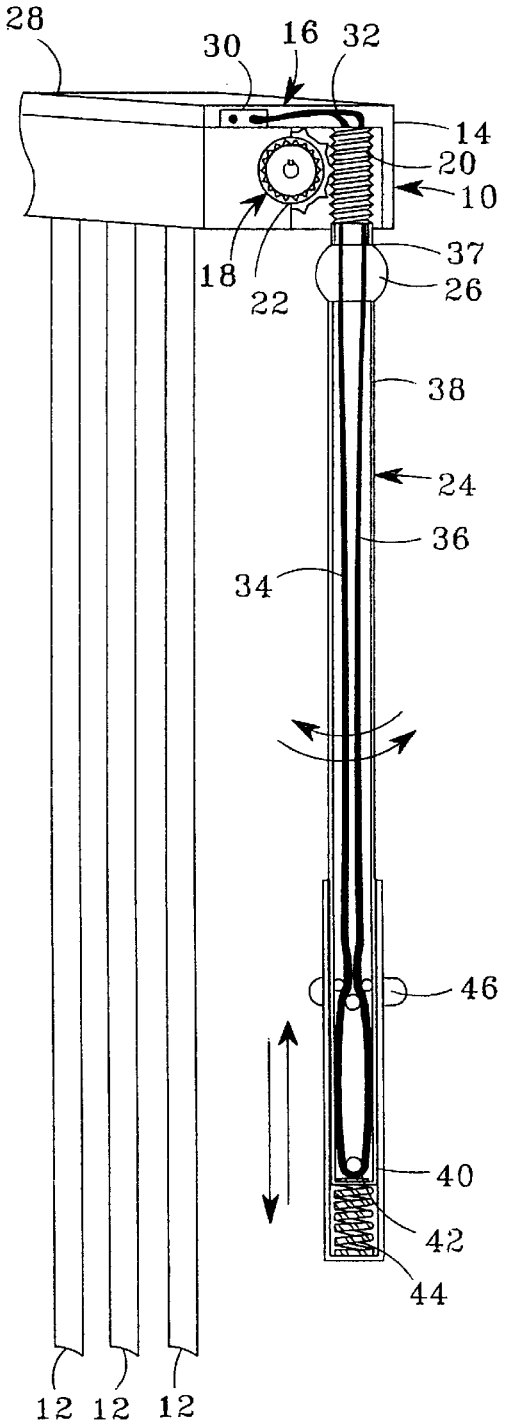
FIG. 1 illustrates a sectional elevation view of the present invention at an original position.

The present invention describes an improved window blind which eliminates potential hazards caused by an exposed looped cord, and provides an improved cord lock for engaging and disengaging the cord length. As used herein, the term "cord" means a string, chain, rope, wire, or other flexible line for operating a mechanism. Referring to FIG. 1, blind 10 is generally formed with louvers or vanes 12, head rail 14, and control mechanism 16. Vanes 12 are illustrated in a vertical position, but can be configured in a horizontal position in other embodiments of the invention described below. Blind 10 is positioned adjacent to a window or door opening (not shown) for the purpose of blocking the transmission of light or air therethrough. Head rail 14 is typically attached at the top of the opening so that vanes 12 are suspended by below head rail 14.

Vane rotating mechanism 18 is attached to head rail 14 and comprises helical worm gear 20 and drive gear 22. Worm gear 20 is engaged with handle 24 through articulated joint 26. Rotation of handle 24 about its longitudinal axis simultaneously rotates worm gear 20 and engaged drive gear 22. Drive gear 22 is engaged with vane carrier 28 for rotation of each vane 12 about the longitudinal axis of each vane 12. Such rotation controls the plurality of vanes 12 to open and to close blind 10.

Closure mechanism 30 is operable to transport vanes 12 across the opening so that vanes 12 are positioned across the opening. As shown in FIG. 1, closure mechanism 30 is operable to move vanes 10 horizontally along head rail 14. Closure mechanism 30 is operated by controlling looped cord 32 having opening length 34 and closing length 36. When opening length 34 is pulled downward, closure mechanism 30 moves vanes 12 toward one side of the opening. When closing length 36 is pulled, closure mechanism 30 moves vanes 12 across the opening so that rotation of vanes 12 closes blind 10.

In a conventional window blind, a cord such as looped cord 32 hangs freely from the head rail and can pose a safety hazard. As shown in FIG. 1, the present invention eliminates this problem by enclosing cord 32 within handle 24. Consequently, the looped end of cord 32 is enclosed and is not exposed to persons proximate to blind 10. In a preferred embodiment of the invention, cord 32 passes through aperture 37 in worm gear 20. This configuration permits the rotation of worm gear 20 independent of cord 32, and further permits the movement of cord 32 independent of worm gear 20.

Figure 2:
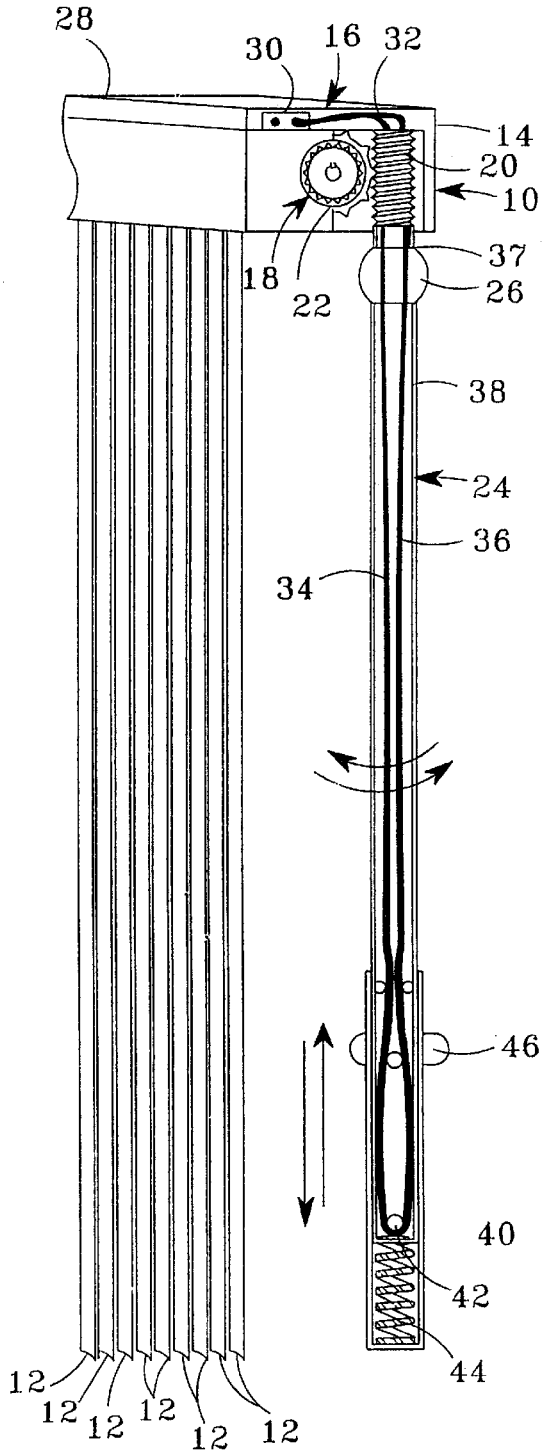
FIG. 2 illustrates a sectional view of the invention after the handle has been operated to move vanes in a window blind.

As shown in FIG. 1, handle 24 is shown as an upper housing 38 and lower housing 40. Cord 32 is looped around pivot 42. Lower housing 40 starts at an original position shown in FIG. 1 and can be pulled downwardly, as shown in FIG. 2, to selectively pull cord 32 to operate closure mechanism 30. Spring 44 connects lower housing 40 to upper housing 38 and returns lower housing 40 to the original position after the pulling force on lower housing 40 has been released. Controller or clasp 46 is engaged with lower housing 40 and selectively grasps opening length 34 or closing length 36.

Figure 3:
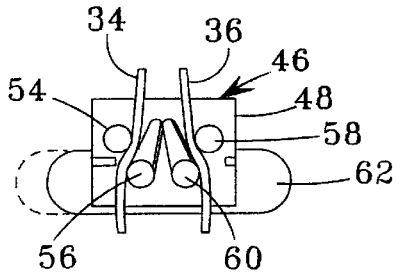
FIG. 3 illustrates a sectional elevation view of a controller for selectively engaging the cord.
Figure 4:
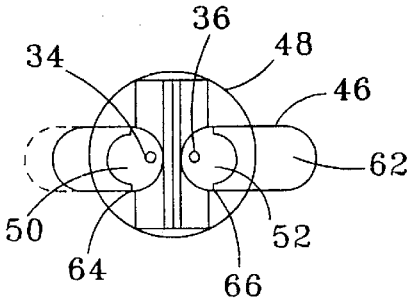
FIG. 4 illustrates a sectional plan view of the controller.

Refering to FIGS. 3 and 4, one embodiment of clasp 46 is illustrated. Clasp 46 includes body 48 having left chamber 50 and right chamber 52. Left chamber 50 has stationary roller 54 and traveling roller 56. Right chamber 52 has stationary roller 58 and traveling roller 60. Opening length 34 of cord 32 passes adjacent stationary roller 54 and traveling roller 56, and closing length 36 passes adjacent stationary roller 58 and traveling roller 60. The space between the stationary rollers and the traveling rollers should be sufficient to permit the free passage of cord 32 therebetween, but is sufficiently small in a preferred embodiment of the invention to create a slight amount of friction between such rollers and cord 32.

Figure 5:
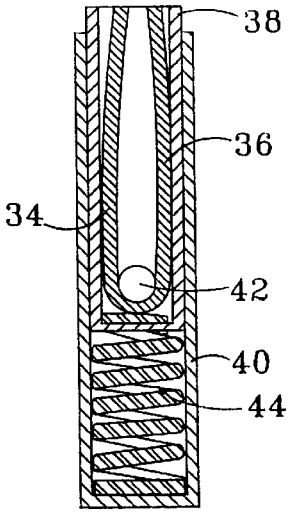
FIG. 5 illustrates a partial sectional view of a spring mechanism for returning the lower housing to the handle.

Switch 62 passes through left chamber 50 and right chamber 52 and extends on either side of clasp 46. As shown in the embodiment of FIG. 1, switch 62 includes left fork 64 and right fork 66. When switch 62 is moved to the right as shown in FIG. 3, left fork 64 interferes with left traveling roller 56. When lower housing 40 and attached clasp 46 are moved downwardly relative to handle 24, right traveling roller 60 moves upwardly relative to clasp 46 and grasps closing length 36 of cord 32 against right stationary roller 58. This operation pulls closing length 36 of cord 32 downwardly and closes vanes 12 across the opening. When the downward force on lower housing 40 is removed, spring 44, with detail shown in FIG. 5, returns lower housing 44 to the original position shown in FIG. 1.

To open blind 10, switch 62 is moved to the left, right fork interferes with right traveling roller 60, and a downward pull on lower housing 40 causes left traveling roller to grasp opening length 34 of cord 32 against left stationary roller 54. Continued downward movement of lower housing 40 pulls opening length 34 to withdraw vanes 12 from across the opening so that blind 10 is opened.

In the embodiment of the invention described above, upper housing 38 and lower housing 40 are operated independently to accomplish the desired functions. Upper housing 38 can be rotated to rotate vanes 12, and lower housing 40 can be operated to move vanes 12 across the opening. The unique combination of these features permits the rotation of upper housing 38 without twisting cord 32 enclosed therein.

Although clasp 46 is depicted in the Figures as a mechanical switching device, many different constructions and embodiments of a clasp can be constructed within the scope of the invention. Clasp 46 performs the function of selectively permitting engagement with opening length 34 or closing length 36 of looped cord 32. This function can be accomplished by different designs and constructions.

Figure 6:
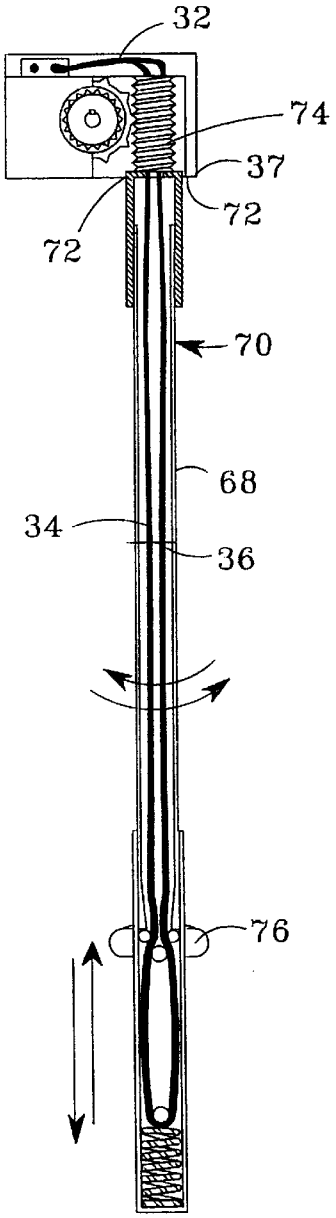
FIG. 6 illustrates an alternative embodiment of the invention.

Lower housing 40 is shown as being smaller than upper housing 38, and as being attached thereto with spring 44. It will be appreciated that many different configurations of upper housing 38 and lower housing 40 can be made within the scope of the invention. For example, lower housing 40 could have a larger diameter than upper housing 38. As shown in FIG. 6, lower housing 68 could substantially comprise the entire length of handle 70. In one variation of this embodiment, lower housing 68 could include prongs 72 engagable with control mechanism 74. When prongs 72 are engaged with control mechanism 74, rotation of lower housing 68 similarly rotates control mechanism 74 to rotate vanes 12. Lower housing 68 can be pulled downwardly to selectively manipulate cord 32 as described above. As shown in FIG. 6, clasp 76 can be connected to lower housing 68 at the bottom end of lower housing 68 to facilitate access to clasp 76.

Figure 7:
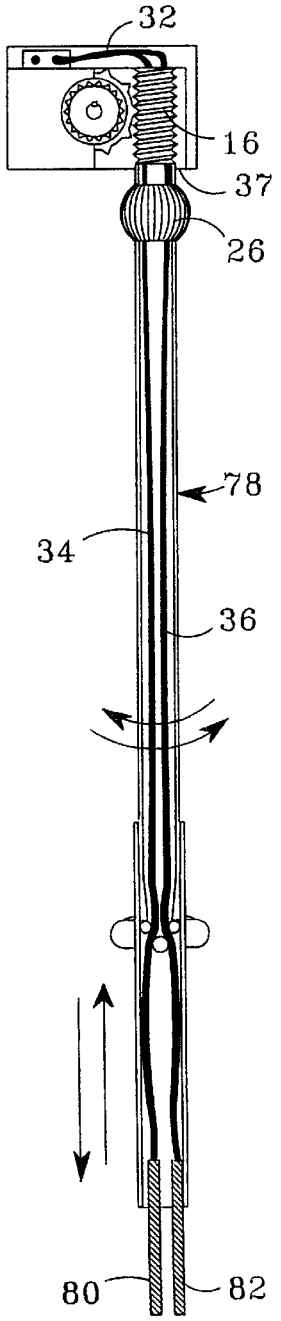
FIG. 7 illustrates an alternative embodiment of the invention.

In another embodiment of the invention shown in FIG. 7, handle 78 can be engaged with control mechanism 16 as shown in FIGS. 1 and 2, and the loop of cord 32 can be severed to free the ends of opening cord length 34 and closing cord length 36. Left wand 80 is attached to opening cord length 34, and right wand 82 is attached to closing cord length 36. Left wand 80 can be pulled downwardly to move vanes 12 to open blind 10, and right wand 82 can be pulled downwardly to move vanes 12 to close blind 10. The upper ends of left wand 80 and right wand 82 are enclosed within handle 78 so that cord length 34 and cord length 36 are never exposed when wands 80 and 82 are operated. As described before, cord lengths 34 and 36 are preferable inserted through aperture 37 in gear 20.

Figure 8:
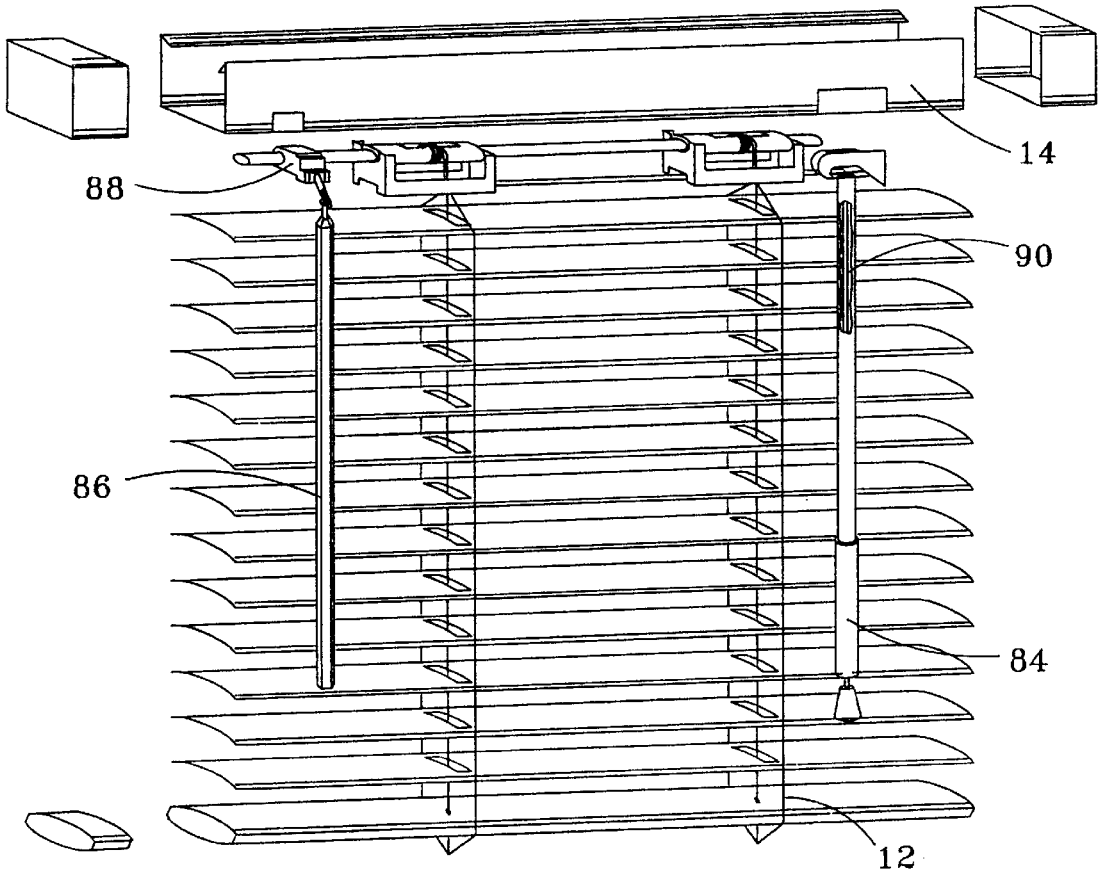
FIG. 8 illustrates a blind having horizontal vanes.

Although the present invention is illustrated in operation with vertical vanes 12, the invention is equally operable with horizontal vanes. As shown in FIG. 8, the operation of cord 84 would move vanes 12 upwardly and downwardly relative to head rail 14. Wand 86 is engaged to rotating mechanism 88 and can be turned to rotatably open and close vanes 12. Cord 84, enclosed within handle 90, can be pulled to raise and lower vanes 12. In an alternative embodiment of the invention, cord 84 could be connected to vane rotating mechanism 88 so that operation of cord length 84 would rotate vanes 12 to open the blind, and operation of cord length wand 86 would rotate vanes 12 to close the blind. The reversability of these functions is easily accomplished by the present invention because handle 90 functions independently of wand 86.

Figure 9:
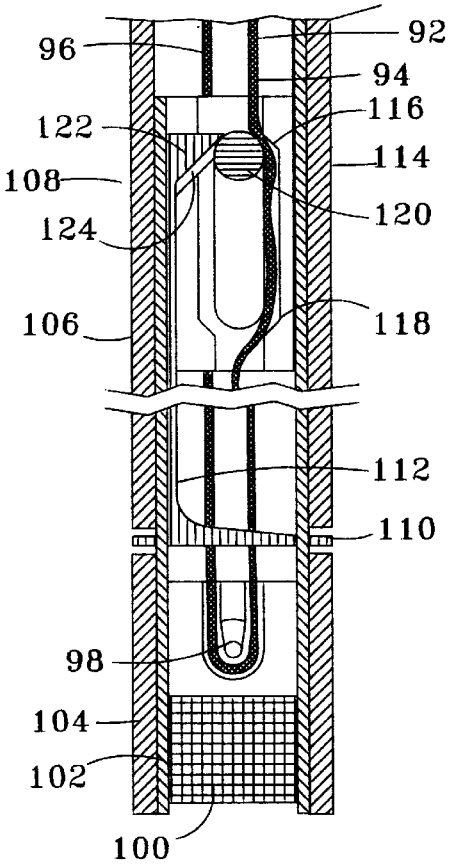
FIG. 9 illustrates one embodiment of an improved cord lock.

Another embodiment of a cord lock switch is illustrated in FIG. 9, wherein looped pull cord 92 has first length 94 and second length 96. Cord 92 is engaged with pulley 98 attached to weight 100. In another embodiment of the invention, a spring can be connected between pulley 98 and handle 102 to prevent slack from forming in cord 92. Cord 92 is enclosed with handle 102 and is engaged with vanes 12 to move vanes 12 vertically or horizontally across the opening. Handle 102 has attached grip 104, and handle 102 can be configured as a cylinder, rectangular or triangular tube, a bar, frame or other shape suitable for accomplishing the desired result.

As shown in FIG. 9, handle 102 is moveable within housing 106. Handle 102 can be moveable in a substantially vertical direction relative to housing 106, and can reciprocate within housing 106. Cord lock mechanism 108 is engaged with handle 102 and generally comprises rotatable mechanism 110, extension 112, and cord lock 114. Extension 112 provides a mechanical mechanism for permitting engagement of first length 94 at a position above handle 102, and reduces the necessary length of handle 102. Rotatable mechanism is illustrated in FIG. 9 as an annular ring rotatable about a longitudinal axis of housing 106. Rotation of rotatable mechanism 110 moves extension 112 and operates cord lock 114 to grip first length 94 of cord 92. Movement of handle 102 pulls first length 94 to move vanes 12 across the opening. Rotatable mechanism 110 can be rotated in the opposite direction to cause cord lock 114 to disengage from first length 94, and handle 102 can be returned to the original position.

FIG. 9 illustrates one embodiment of cord lock 114, wherein cord lock 114 comprises stop 116, cage 118, and ball 120 moveable within cage 118 for selectively gripping first length 94. Ball 120 slightly contacts first length 94, so that movement of cage 118 causes ball 120 to tightly grip first length 94 against stop 116. In this configuration, cord lock 114 is engaged with first length 94, and movement of downward movement of handle 102 operates cord 92 to move vanes across the opening.

Figure 10:
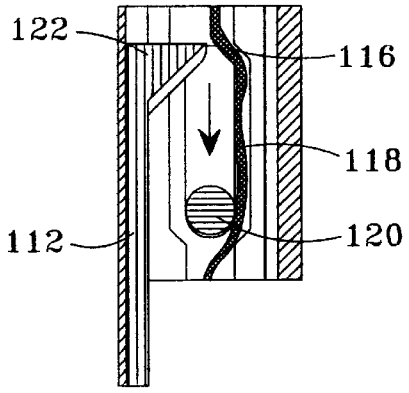
FIG. 10 illustrates the cord lock disengaged from the cord length.
Figure 11:
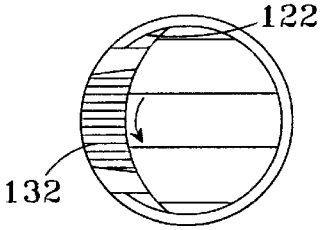
FIG. 11 illustrates a plan view of a ball release mechanism.

Ball release 122 is illustrated as being attached to the upper end of extension 112 as shown in FIG. 10. Ball release 122 has a beveled surface 124 for disengaging ball 120 from contact with first length 94 when rotatable mechanism 110 and extension 112 are rotated in a particular direction. A plan view of ball release is shown in FIG. 11. Ball 120 is pushed downward within cage 118 so that ball 120 does not grip first length 94, thereby disengaging cord lock 114 from cord 92 as shown in FIG. 9. Rotatable mechanism 110 and extension 112 can be rotated in the opposite direction to remove beveled surface 124 from cage 118, thereby permitting ball 120 to engage first length 94 against stop 116 as illustrated in FIG. 10. In this configuration, cord lock 114 engages first length 94 so that movement of handle 102 operates cord 92.

Figure 12:
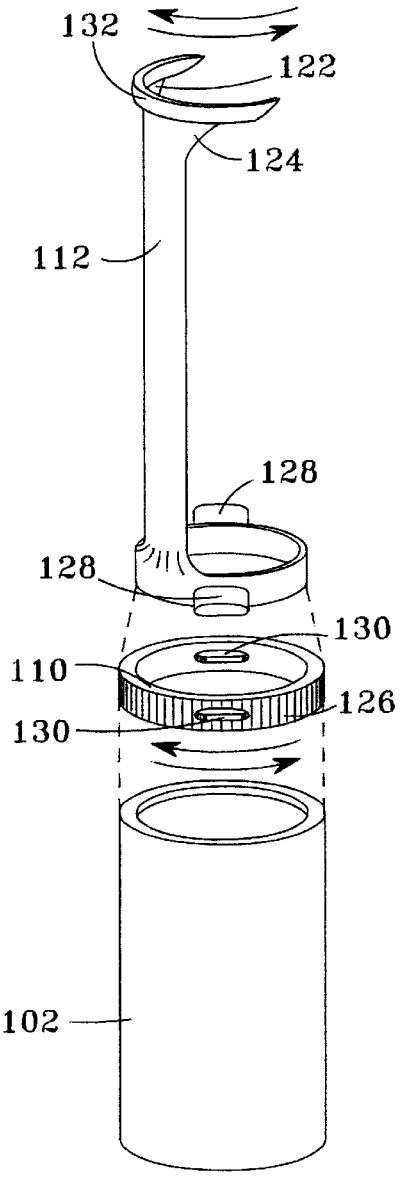
FIG. 12 illustrates an exploded view of a cord lock mechanism.

One embodiment of cord lock mechanism 108 is shown in FIG. 12 in expanded form, wherein rotatable mechanism 110 is illustrated as an annular ring having a serrated outside grip surface 126. The lower end of extension 112 has tabs 128 for locking engagement with apertures 130 in rotatable mechanism 110. Ball release 122 is attached to the upper end of extension 112 and has an arcuate member 132 having beveled surface 124 for selectively contacting ball 120 as previously described.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for selectively engaging and disengaging a vertical blind cord operable to move the vanes relative to an opening, comprising:

a vertically moveable handle;

a rotatable mechanism proximate to the handle and vertically moveable with the handle;

an extension attached to said rotatable mechanism; and a cord lock engaged with said extension and comprising a stop, a cage and a ball moveable within the cage for selectively gripping the cord between said ball and said stop, wherein rotation of said rotatable mechanism and said extension operates said cord lock to selectively engage the cord so that vertical movement of the handle moves said cord lock and the cord in a vertical direction for moving the vanes relative to the opening.

2. An apparatus as recited in claim 1, wherein said cord lock further comprises a ball release.

3. An apparatus as recited in claim 2, wherein said ball release is attached to an upper end of said extension.

4. An apparatus as recited in claim 3, wherein said ball release includes a beveled surface for disengaging said ball from engagement with the cord when said rotatable mechanism is operated.

5. An apparatus for moving horizontal blind vanes relative to an opening, comprising:

a pull cord operable to selectively transport the vanes vertically across the opening, wherein said pull cord has a looped end;

a moveable handle engaged with the looped end of said pull cord and having a longitudinal axis through said handle;

a rotatable mechanism proximate to the handle for rotation about the longitudinal axis of said handle;

an extension attached to said rotatable mechanism; and a cord lock engaged with said extension and comprising a stop, a cage, and a ball moveable within the cage for selectively gripping said pull cord between said ball and said stop, wherein rotation of said rotatable mechanism and said extension operates said cord lock to selectively engage the pull cord so that movement of said handle moves the pull cord to transport the vanes relative to the opening.

6. An apparatus as recited in claim 5, wherein said cord lock further comprises a ball release.

7. An apparatus as recited in claim 6, wherein said ball release is attached to an upper end of said extension.

8. An apparatus as recited in claim 7, wherein said ball release is moveable into said cage, upon rotation of said rotatable mechanism and extension, to release said ball from engagement with said pull cord.

9. An apparatus as recited in claim 7, wherein said ball release is moveable from said cage, upon rotation of said rotatable mechanism and extension, to permit said ball to engage said pull cord.

* * * * *